US009194177B2

(12) United States Patent
Anthony et al.

(10) Patent No.: US 9,194,177 B2
(45) Date of Patent: Nov. 24, 2015

(54) OPERATING CORD SYSTEM FOR RETRACTABLE COVERINGS FOR ARCHITECTURAL OPENINGS

(75) Inventors: James M. Anthony, Denver, CO (US); Kevin M. Dann, Englewood, CO (US); Daniel Fluckey, Denver, CO (US); Joseph E. Kovach, Brighton, CO (US); Jeffrey L. Spray, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 13/993,414

(22) PCT Filed: Dec. 30, 2011

(86) PCT No.: PCT/US2011/068074
§ 371 (c)(1),
(2), (4) Date: Jun. 12, 2013

(87) PCT Pub. No.: WO2012/092549
PCT Pub. Date: Jul. 5, 2012

(65) Prior Publication Data

US 2013/0299102 A1 Nov. 14, 2013

Related U.S. Application Data

(60) Provisional application No. 61/428,682, filed on Dec. 30, 2010, provisional application No. 61/431,302, filed on Jan. 10, 2011, provisional application No. 61/433,869, filed on Jan. 18, 2011.

(51) Int. Cl.
*E06B 9/80* (2006.01)
*E06B 9/56* (2006.01)
(Continued)

(52) U.S. Cl.
CPC . *E06B 9/56* (2013.01); *E06B 9/262* (2013.01); *E06B 9/324* (2013.01); *E06B 9/326* (2013.01); *E06B 2009/2627* (2013.01); *E06B 2009/802* (2013.01)

(58) Field of Classification Search
USPC ..... 160/302, 303, 304.1, 300, 301, 307, 160/308, 178.2, 321
IPC ..... E06B 2009/802
See application file for complete search history.

(56) References Cited

U.S. PATENT DOCUMENTS 521,408 A * 6/1894 Goldmann ..... 160/307
1,862,163 A * 6/1932 Russell ..... 160/133
(Continued)

FOREIGN PATENT DOCUMENTS

DE 29611473 U1 9/1996
EP 0666404 A1 8/1995

OTHER PUBLICATIONS

Extended European Search Report dated Jan. 8, 2015, Application No. 11854221.6, 8 pages.

*Primary Examiner* — David Purol
(74) *Attorney, Agent, or Firm* — Dorsey & Whitney LLP

(57) ABSTRACT

An operating control system for a retractable shade including a roller reversibly rotatable within a headrail includes a clamp system for gripping an endless operating cord in a neutral position to prevent rotation of the roller and a tensioner if properly mounted in a fixed position will release the clamp system to permit rotation of the roller while positioning the runs of the endless cord in a closely spaced relationship to minimize the risk of an infant or child becoming entangled in the cord.

17 Claims, 12 Drawing Sheets

(51) Int. Cl.

| | |
|---|---|
| ***E06B 9/262*** | (2006.01) |
| ***E06B 9/324*** | (2006.01) |
| ***E06B 9/326*** | (2006.01) |

(56) References Cited

U.S. PATENT DOCUMENTS

| | | | | | |
|---|---|---|---|---|---|
| 1,941,383 | A | * | 12/1933 | Benson | 24/134 KB |
| 2,564,831 | A | * | 8/1951 | Butkus | 188/65.1 |
| 2,731,111 | A | | 1/1956 | Lorentzen | |
| 3,123,351 | A | * | 3/1964 | Graber | 267/71 |
| 4,932,456 | A | * | 6/1990 | Buxbaum | 160/321 |
| 5,092,389 | A | * | 3/1992 | Tedeschi | 160/321 |
| 5,167,269 | A | | 12/1992 | Abo | |
| 5,232,038 | A | * | 8/1993 | Buxbaum | 160/308 |
| 5,275,222 | A | | 1/1994 | Jelic et al. | |
| 5,706,552 | A | * | 1/1998 | Hsieh | 16/82 |
| 5,845,696 | A | * | 12/1998 | Chou | 160/178.1 V |
| 7,114,544 | B2 | * | 10/2006 | Rice et al. | 160/178.1 V |
| 8,505,609 | B2 | * | 8/2013 | Huang | 160/293.1 |
| 8,695,680 | B2 | | 4/2014 | Cannaverde | |
| 2005/0115684 | A1 | | 6/2005 | Judkins et al. | |
| 2006/0048907 | A1 | | 3/2006 | Rice et al. | |
| 2010/0101741 | A1 | * | 4/2010 | Koop | 160/321 |

* cited by examiner

OPERATING CORD SYSTEM FOR RETRACTABLE COVERINGS FOR ARCHITECTURAL OPENINGS

CROSS-REFERENCE TO RELATED APPLICATIONS

This application is the national stage application of PCT Patent Application No. PCT/US2011/068074, filed on 30 Dec. 2011 and entitled "Operating Cord System For Retractable Coverings For Architectural Openings", which claims the benefit under 35 U.S.C. 119(e) to U.S. Provisional Patent Application No. 61/428,682 filed on 30 Dec. 2010 and entitled "Operating Cord System For Retractable Coverings For Architectural Openings ", U.S. Provisional Patent Application No. 61/431,302 filed on 10 Jan. 2011 and entitled "Operating Cord System For Retractable Coverings For Architectural Openings", and U.S. Provisional Patent Application No. 61/433,869 filed on 16 Jan. 2011 and entitled "Operating Cord System For Retractable Coverings For Architectural Openings", which are incorporated by reference herein in their entireties.

BACKGROUND

1. Field

The present disclosure relates generally to retractable coverings for architectural openings such as windows, doorways, archways, and the like, and more particularly to a system for mounting and controlling the operating cord for such coverings to minimize risk to infants who might otherwise be harmed by having a body part entangled within the operating cord.

2. Description of the Relevant Art

Retractable coverings for architectural openings have taken numerous forms for many years. Many retractable coverings have a roller across the top of the architectural opening, and an operating system including clutches, brakes or the like for rotating the roller with the operating system typically comprising one or more pull cords at one end of the roller so that the pull cords can be selectively pulled, or, in the case of an endless pull cord, circulated to cause the roller to rotate in one direction or another about its longitudinal axis. The roller itself might anchor the top edge of a shade material in which case the shade material can be wrapped around the roller in a retracted position of the covering or extended into a suspended position relative to the roller when it is unwrapped from the roller. The rollers might also be used to anchor one end of a plurality of lift cords which extend from the roller to a bottom rail of the covering so that by rotating the roller about its longitudinal axis, the lift cords can be wrapped around the roller to raise the bottom rail toward the roller and by rotating the roller in the opposite direction, the lift cords can be unwrapped from the roller to lower the bottom rail thereby extending the covering across the architectural opening.

The roller is typically reversibly rotated by an operating cord sometimes referred to as a pull cord. The operating cord (which might constitute two separate and independent cords) is operatively connected to the roller so that by pulling the pull cord or operating cord, in one direction or the other, the roller can be selectively rotated in one direction or the other. Sometimes the operating cord is an endless cord which forms a closed loop that is operatively connected to the roller so that by circulating the closed loop operating cord in one direction, the roller is caused to rotate in a corresponding direction, while circulating the operating cord in the opposite direction causes the roller to rotate in an opposite direction. Circulating movement of such an endless cord in one direction or the other causes the covering for the architectural opening to move between extended and retracted positions. Such retractable systems typically include a clutch/brake system to selectively retain the roller in any predetermined position.

Endless operating cords can pose significant risks to infants or small children who might become entangled in the loop of cord hanging from the end of the roller. Accordingly, efforts have recently been made to control the operating cord to minimize the risk of an infant or child becoming entangled in the cord.

SUMMARY

The present disclosure has been developed to provide an endless loop operating cord system for retractable coverings for architectural openings which is not only functional in reversibly rotating a roller about which a shade material, lift cords, or the like can be wrapped or unwrapped but to also assure the endless cord is properly mounted to minimize the risk of entanglement with a body part of an infant or small child.

The endless loop operating cord of the disclosure is operatively connected to a roller so that circulating movement of the cord in one direction causes the roller to rotate in a corresponding direction and circulating movement of the operating cord in an opposite direction causes the roller to rotate in an opposite direction. The lower end of the looped cord passes through a tensioner adapted to be anchored to the frame of the architectural opening so that the operating cord remains in a controlled fixed location relative to the covering and close to the frame around the architectural opening. Pursuant to the present disclosure, if the tensioner is not mounted, or is not mounted correctly to place a predetermined tension in the cord, the covering may be prevented from being operated.

A releasable clamp system is positioned adjacent to the end of the roller and is operatively connected to the operating cord so that each run of the operating cord extending from the roller passes through the releasable clamp system. The releasable clamp system is movable from a locked position to an unlocked position when the tensioner is properly mounted. In one embodiment, the clamp system includes a pair of abutments positioned adjacent to each run of the operating cord as it leaves the roller, and a pair of associated movable dogs biased to selectively engage an associated run of the operating cord to pinch the cord against the abutment and thereby maintain a releasably fixed non-operative or locked position of the operating cord unless the tensioner is properly mounted. In alternative embodiments, a drive wheel on the roller serves as the abutment so the cord does not need to be engaged at all. If the tensioner is properly mounted, the clamp system becomes unlocked and the roller can be conventionally rotated with the cord to extend or retract the covering.

The clamping engagement of a dog with the cord or the drive wheel is the normal position of the clamp system so it is normally locked, but it can be selectively released by pulling the operating cord, which occurs when the tensioner is properly mounted, which moves the associated dogs away from the cord or the drive wheel against a bias applied to the dogs so that the cord is free to circulate between the dogs and their associated abutments and the covering can work properly. If the pulling force on the operating cord is released, as may occur if a tensioner is not secured in position or is secured in a position that does not apply enough pull on the cord to retain a released or unlocked position of the clamp system, the bias applied to each dog holds the dog against the associated run of the cord or the drive wheel to prevent the cord from circulating and hold the cord in a releasably fixed position so the covering cannot be operated.

In this manner, in order to render the covering operational, the operating cord must be retained in a relatively taut condition to keep the dogs separated from the cord or the drive wheel depending on the embodiment. When the cord is taut, it is confined immediately adjacent to the covering and the frame for the architectural opening on which it is mounted with the vertical runs of the cord closely spaced to minimize the risk of an infant or child becoming entangled therein. The cord may retain a circulating position when the tensioner is properly mounted in fixed relationship with the frame around the architectural opening.

Other aspects, features and details of the present disclosure can be more completely understood by reference to the following detailed description of preferred embodiments, taken in conjunction with the drawings and from the appended claims.

DETAILED DESCRIPTION

Figure 1:
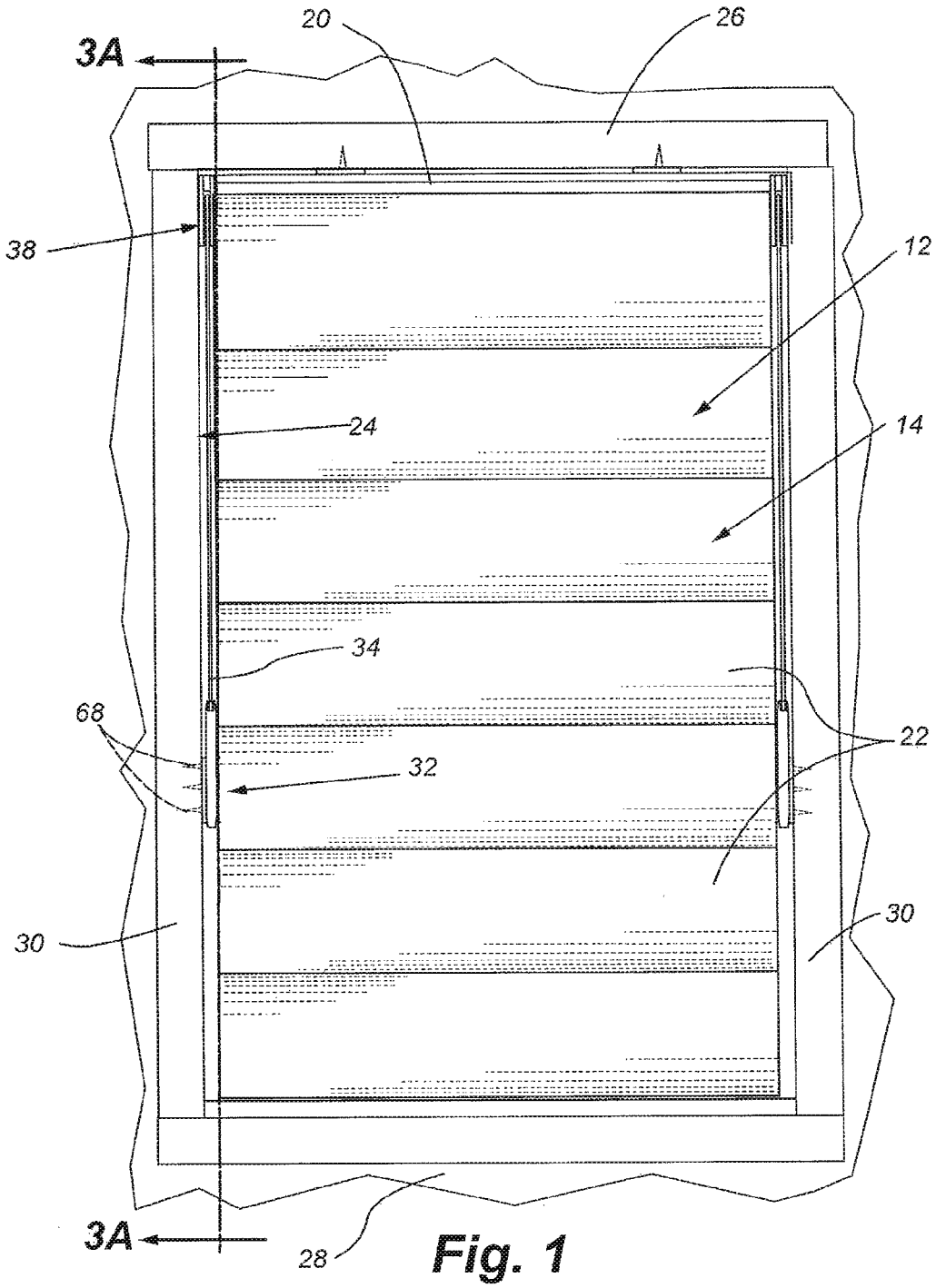
FIG. 1 is a front elevation of a retractable covering in an extended position within an architectural opening incorporating the operating cord system of the present disclosure.
Figure 2:
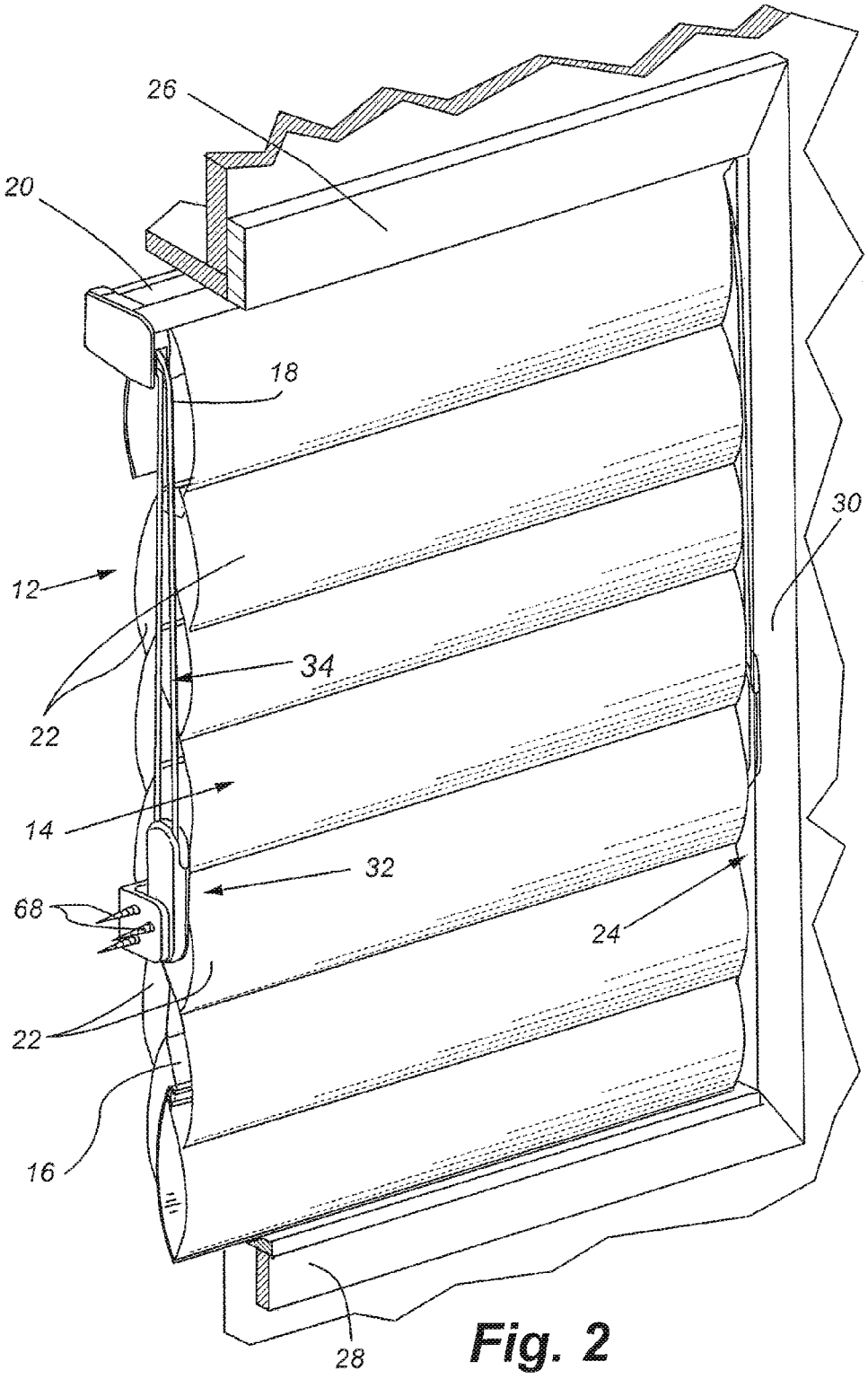
FIG. 2 is a fragmentary isometric of the covering for an architectural opening as shown in FIG. 1, again with the covering in an extended position.

A retractable covering 12 for an architectural opening incorporating the operating cord system of the present disclosure can be seen in FIGS. 1 and 2. While the operating cord system of the disclosure could be incorporated into many different retractable coverings that incorporate a rotatable roller or spool at the top of the covering about which a shade or lift cords could be wrapped and unwrapped, for illustrative purposes, the present disclosure will be described in connection with a roll-up shade 14 having a backing sheet 16 suspended from a horizontally disposed roller 18 confined within a headrail 20 of the covering and with the backing sheet supporting a plurality of overlapping vanes 22 on opposite faces thereof. The covering can be moved into a retracted position by rotating the roller pursuant to the disclosure as described hereafter causing the shade material to wrap around the roller or unwrapping the shade material from the roller by rotating the roller in an opposite direction so the covering is moved to an extended position (FIGS. 1 and 2) with the shade material suspended from the roller across the architectural opening 24 in which the covering is mounted. Some retractable coverings frequently referred to as roll-up coverings, shades or the like, have a top edge of the shade material secured to the roller so that the shade material itself is wrapped about or unwrapped from the roller while other coverings, such as venetian blind type coverings merely have lift cords which will wrap or unwrap about the roller to raise or lower a bottom rail of the blind respectively when moving the covering between retracted and extended positions.

The covering 12 used for illustrative purposes in describing the control system for the present disclosure includes a headrail 20, which is secured to a frame member 26 for the architectural opening across the top thereof. The frame also includes a bottom frame member 28 as well as vertically extending side frame members 30 used to anchor a tensioner 32 for an operating cord 34 in accordance with the present disclosure as will be discussed hereafter.

Rollers or spools used in retractable coverings typically include clutch/brake systems (not seen) which permit the roller to selectively rotate in either direction but will retain the roller in a fixed position when not being rotated. With the operating cord system of the present disclosure, the roller will operate conventionally only if the tensioner 32 is correctly mounted to maintain a released condition of a clamp system 36.

The first embodiment of the operating cord system of the present disclosure is seen best in FIGS. 1-4B. Referencing FIG. 3A, the end of the headrail 20, having an operating cord system pursuant to the present disclosure, is illustrated. As will also be appreciated by reference to FIGS. 1 and 2, a similar operating system could be mounted at the opposite end of the headrail for operating other features of a shade which might require two distinct operating systems. The second operating system would operate in the same manner as the operating system to be described in detail hereafter even though the system may reversibly rotate an element distinct from the roller to control other features of the covering.

Figures 3A, 3B:
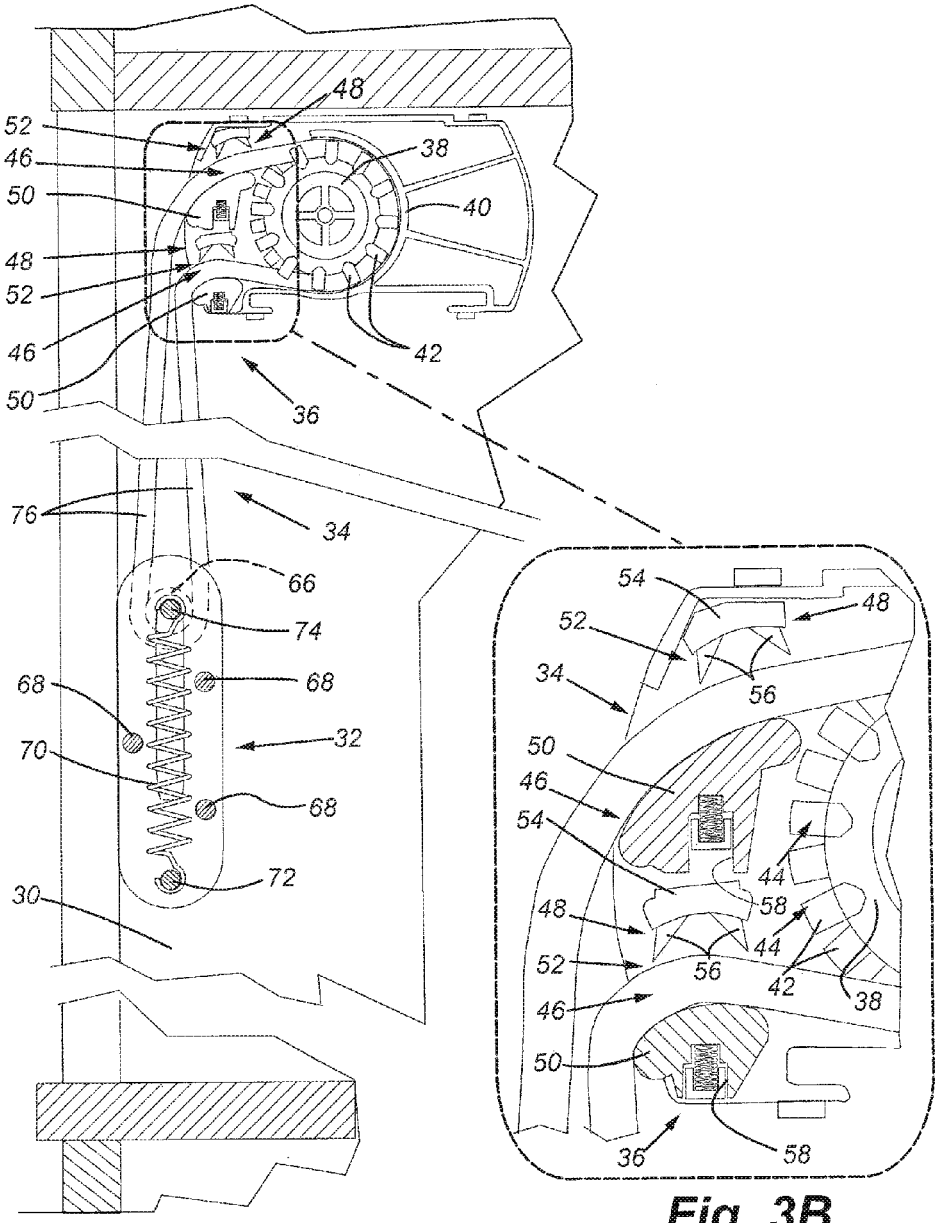
FIG. 3A is an enlarged fragmentary section taken along line 3A-3A of FIG. 1 showing the clamping system in a neutral nongripping position.
FIG. 3B is an enlarged view of the area circled with dashed lines in FIG. 3A.

In FIG. 3A, the roller 18 has a coaxial drive wheel 38 on the end thereof which is keyed to the roller so as to rotate therewith. The drive wheel is confined within guide ribbing 40 provided in the headrail 20 so the drive wheel and the roller to which it is keyed are reversibly rotatable about the longitudinal axis of the roller.

The drive wheel 38 includes circumferentially spaced, radially directed gripping teeth 42 which define saddles or pockets 44 through which the operating cord 34 extends. The teeth grip the cord as it extends partially around the wheel so that circulating movement of the operating cord, i.e. movement of the operating cord in an orbital path, will cause the drive wheel to rotate in unison therewith and consequently with the roller 18 operatively connected to the shade material 14.

In the embodiment illustrated in FIG. 3A, the control cord 34 emanates from a top and bottom of the drive wheel 38 in a lateral rearward direction transverse to the length of the roller and in doing so passes through the clamp system 36 that releasably grips the operating cord in its neutral condition.

Figures 4A, 4B:
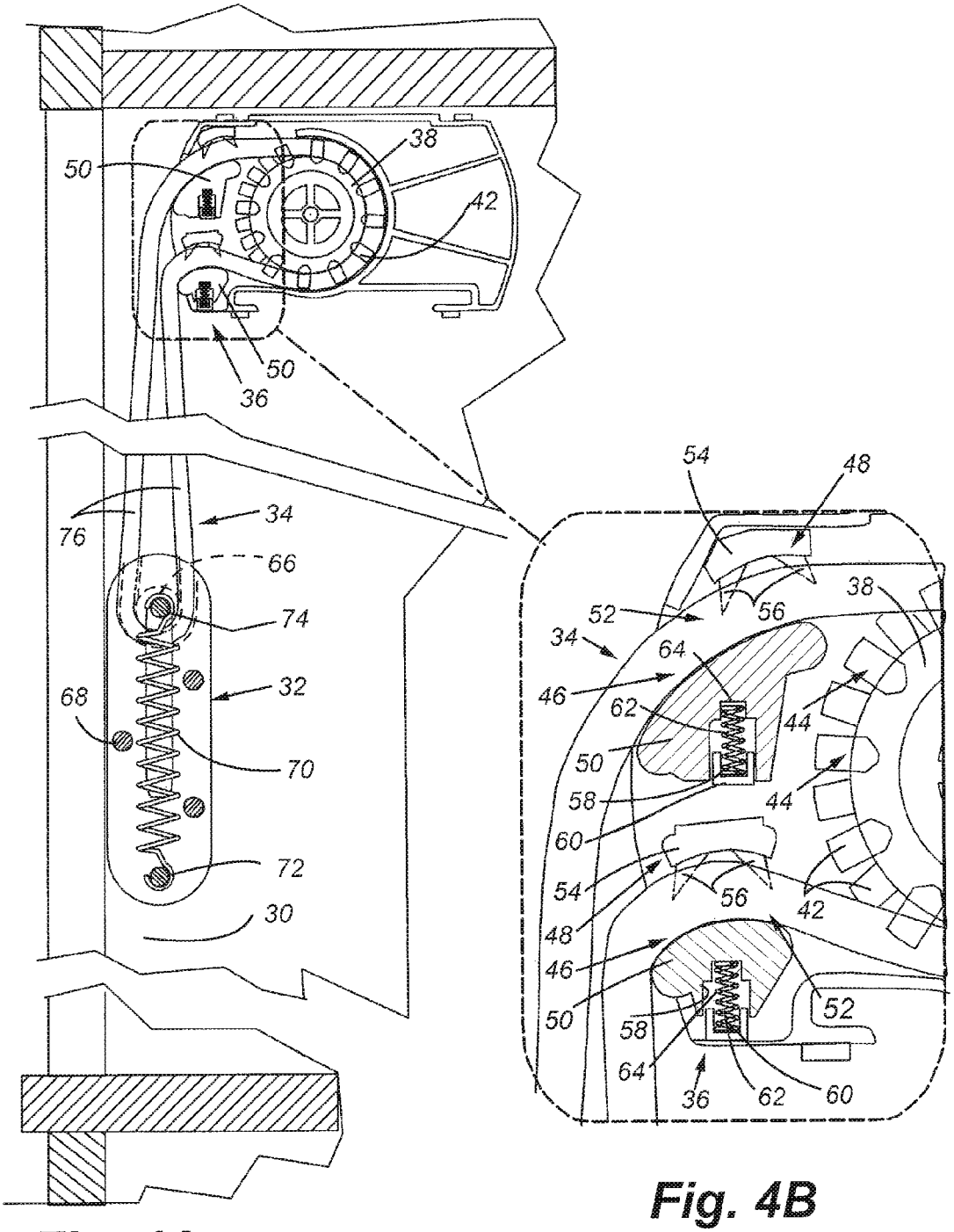
FIG. 4A is a sectional view similar to FIG. 3A showing the clamp system in a gripping position.
FIG. 4B is an enlarged view of the area shown with dashed lines in FIG. 4A.
Figure 5:
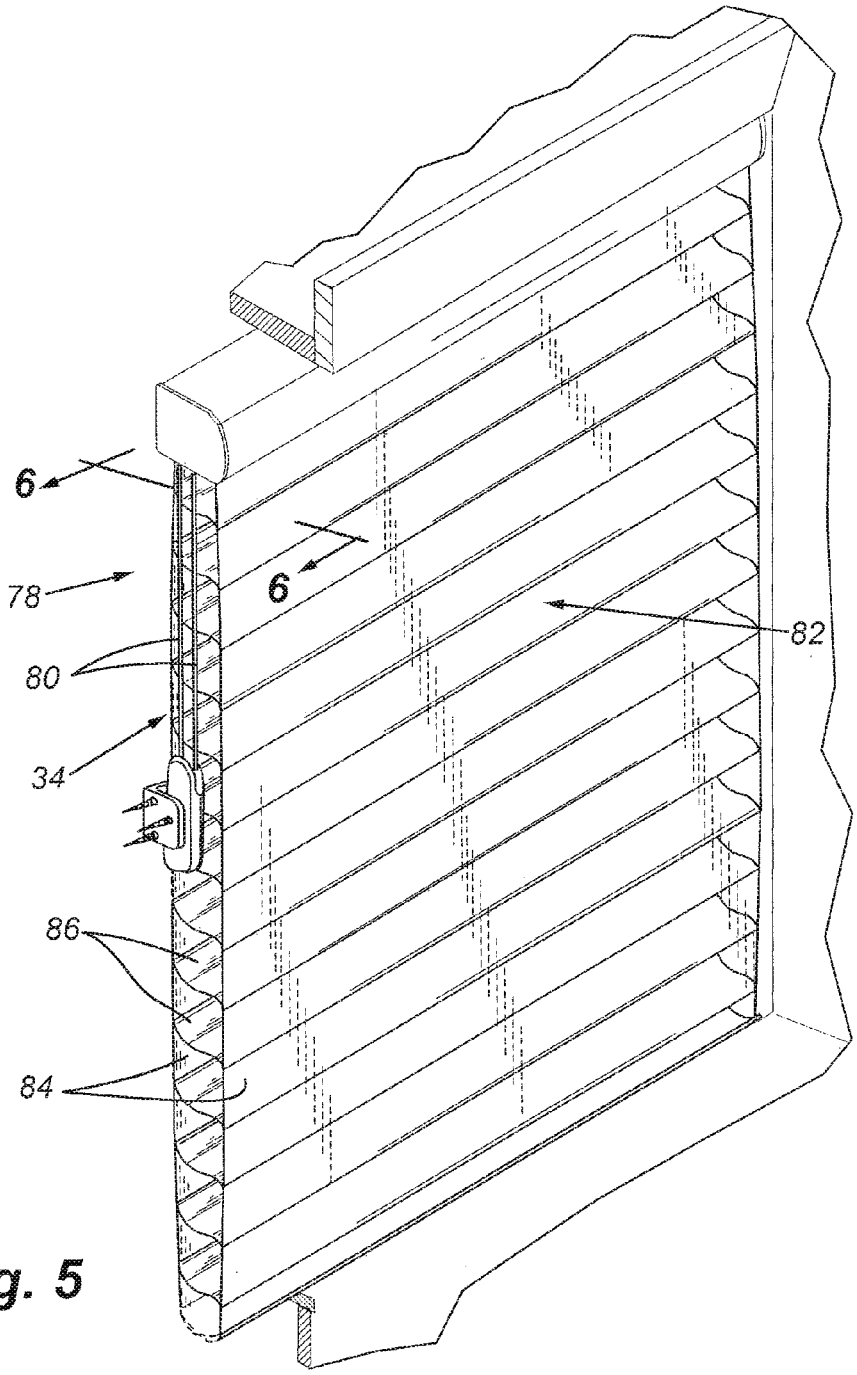
FIG. 5 is an isometric with parts removed showing a different covering incorporating a second embodiment of an operating cord system.

Referring to FIG. 3B, the clamp system 36 is more clearly illustrated as including a pair of independent clamps 46 each having an overlying abutment 48 and an underlying resiliently and upwardly biased dog 50 defining a path 52 therebetween through which one run of the operating cord passes. FIGS. 4A and 4B correspond to FIGS. 3A and 3B except FIGS. 4A and 4B illustrate the clamp system in a neutral or gripping position, while FIGS. 3A and 3B show the clamp system in a released or nongripping position.

The abutments 48 used in each clamp of the clamp system are identical fixed blocks 54 which are secured to the headrail 20 and are oriented to be aligned with the path 52 through which the associated run of the operating cord 34 passes. The abutment blocks are illustrated with a pair of teeth 56 which form a gripper adapted to penetrate the operating cord to establish a positive grip thereon even though the teeth may not be necessary depending upon the coefficient of friction of the material from which the abutment is made. A serrated surface might also be used in place of the teeth or a relatively high friction material (not shown) secured to the face of the abutment block may be positioned to engage the associated run of the operating cord.

The dogs 50 associated with each clamp component 46 of the clamp system 36 while having slightly different cross-sectional configurations are preferably made of the same material and mounted in the same way so as to have a pocket 58 defined in a bottom surface thereof adapted to reciprocally fit over a seat 60 for a compression spring 62 with the upper end of the compression spring confined within a reduced diameter portion 64 of the pocket 58. The dogs are therefore biased upwardly toward the path 52 through which an associated run of the operating cord extends, and the strength of the compression spring is such that in its neutral or clamping position it forces the dog and the associated run of the operating cord into gripping engagement with the abutment as illustrated in FIGS. 4A and 4B. An adequate axially downwardly force applied to a run of the operating cord along the length of the run applies a downward force on the associated dog overcoming the bias of the compression spring so that the path between the dog and its associated abutment is sufficiently wide to allow sliding or circulating movement of the operating cord therethrough. This downward force is applied when properly mounting the system as will be explained hereafter. If the tensioner is not properly mounted, the clamps will remain in their neutral gripping position and a downward force on either run of the cord might release its associated dog but the other dog will not release so the cord will not move and the covering may not be operated.

The dogs 50 may be made of a relatively hard material so as to provide a long wear surface across which an operating cord 34 can slidably pass. Ceramics have been found desirable for this purpose. In this embodiment of the disclosure, it will be appreciated the operating cord extends rearwardly out of the headrail even though as it will be appreciated with a later described embodiment, the operating cord could extend downwardly through an opening in the bottom of the headrail depending upon the space permitted within the architectural opening for the mounting of the covering.

Referring to FIGS. 3A and 4A again, it will be appreciated the lower end of the closed loop operating cord 34 passes around a rotatable pulley 66 mounted in the tensioner 32 which is securable to a side frame member 30 around the architectural opening with screw-type fasteners 68. The pulley is slidably mounted for vertical sliding movement within the tensioner and is biased downwardly by a coil spring 70 having its lower end anchored to a pin 72 in the tensioner, and its upper end to the axle 74 of the pulley. By properly positioning the tensioner along the side frame member and/or preselecting a coil spring of the desired tension, a desired tension or tautness can be created in the operating cord, which is sufficient to pull the dogs downwardly and obtain a released condition of the clamp system.

In other words, the operating cord 34, after being mounted for circulation around the drive wheel 38 of the roller 18, and the pulley 66 in the tensioner 32, may form a tight loop with the vertical runs 76 of the loop being closely spaced and closely adjacent to the frame around the architectural opening. Such an arrangement minimizes the possibility of an infant or child getting a body part entangled within the loop.

FIGS. 6-10 illustrate a second embodiment of an operating cord system 78 pursuant to the present disclosure with this embodiment illustrating runs 80 of the operating cord 34 extending downwardly through the bottom of the headrail 20 rather than laterally through the back of the headrail.

Figure 6:
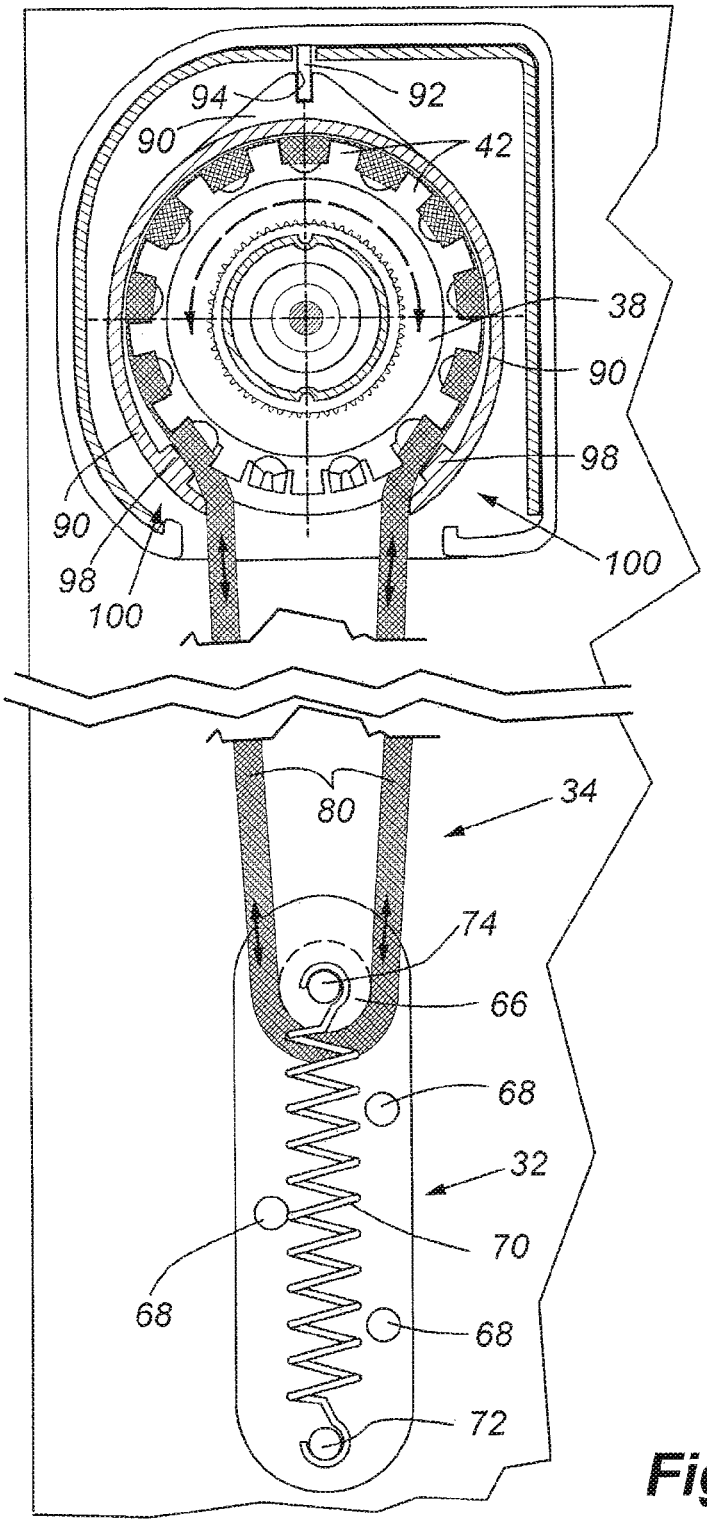
FIG. 6 is an enlarged section taken along line 6-6 of FIG. 5.

For illustrative purposes, a retractable shade material 82 is illustrated, which is different from that of the first described embodiment, and wherein front and rear sheets 84 of support material are interconnected at vertically spaced locations by horizontally extending vanes 86 with the entire shade fabric being wrappable about the roller 18 for the covering in a retracted position or unwrapped and suspended from the roller across the architectural opening as shown in FIG. 6. The roller, which may be identical to that of the first embodiment, again has a toothed drive wheel 38 on one end thereof which is associated with the operating cord system of the present disclosure similar to the first-described embodiment. A similar operating system could be provided at the opposite end of the covering even though it is not illustrated.

The drive wheel 38, as seen best in FIGS. 7-10, again has a plurality of circumferentially spaced but radially extending teeth 42 defining saddles or seats 88 in which the operating cord is positioned as it extends substantially around the drive wheel. The teeth are designed to grip the cord so that as the operating cord is circulated, the drive wheel is rotated in unison therewith so as to also rotate the roller accordingly. In this embodiment, a generally cylindrical shroud 90 having a length sufficient to cover the width of the drive wheel 38 is mounted within the headrail 20 and held in position by a rib 92 along the length of the headrail which is secured within a slot 94 of the shroud. The shroud is made of a substantially rigid, but slightly flexible and resilient material, such as a polycarbonate, with the shroud having opposed edges 96 near the bottom thereof and internally directed dogs 98 mounted adjacent to the edges and on the inner surface of the shroud. As will be described hereafter, the dogs are provided to grip the drive wheel and/or the operating cord in a neutral locked position. The dogs are biased inwardly by the shroud.

Similarly to the first-described embodiment, a tensioner 32 is anchored to a side frame member 30 along the architectural opening by screw-type fasteners 68, and the tensioner includes a vertically slidable pulley 66 around which the operating cord 34 extends with the pulley being biased downwardly by a coil spring 70 whose lower end is anchored to a pin 72 in the tensioner, and its upper end to the axle 74 of the pulley. Again, the tension in the spring and the location of the tensioner along the side frame member 30 is predetermined to provide a tautness in the operating cord which assures that the vertical runs 76 of the operating cord remain in a taut condition and with enough tension to make sure the cord pulls the dogs 98 downwardly enough to overcome the bias of the shroud 90 and release the clamp so the drive wheel can be reversibly rotated by the cord.

Figure 7:
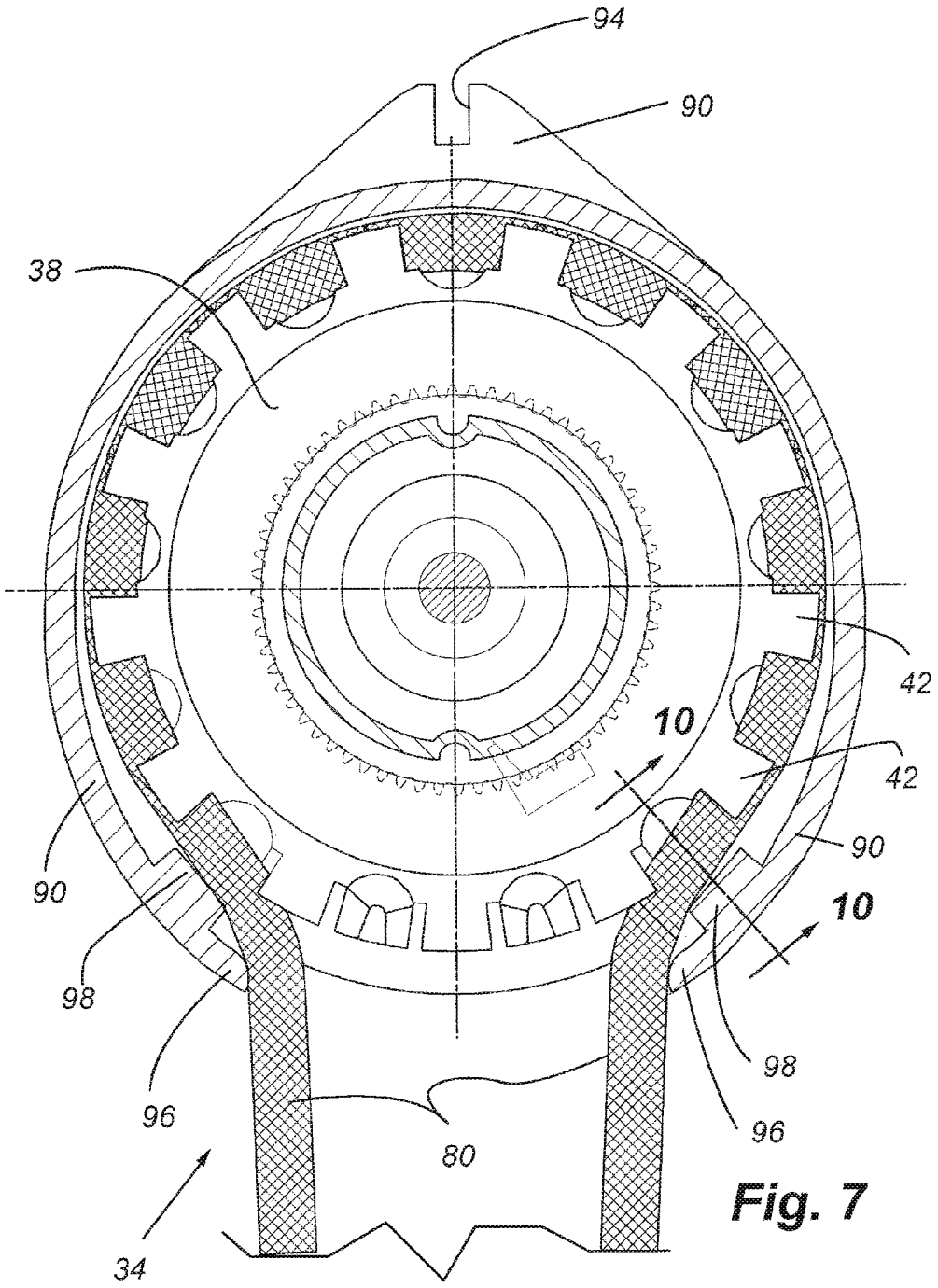
FIG. 7 is a further enlarged section similar to FIG. 6 showing the clamp system in a nongripping position.
Figure 8:
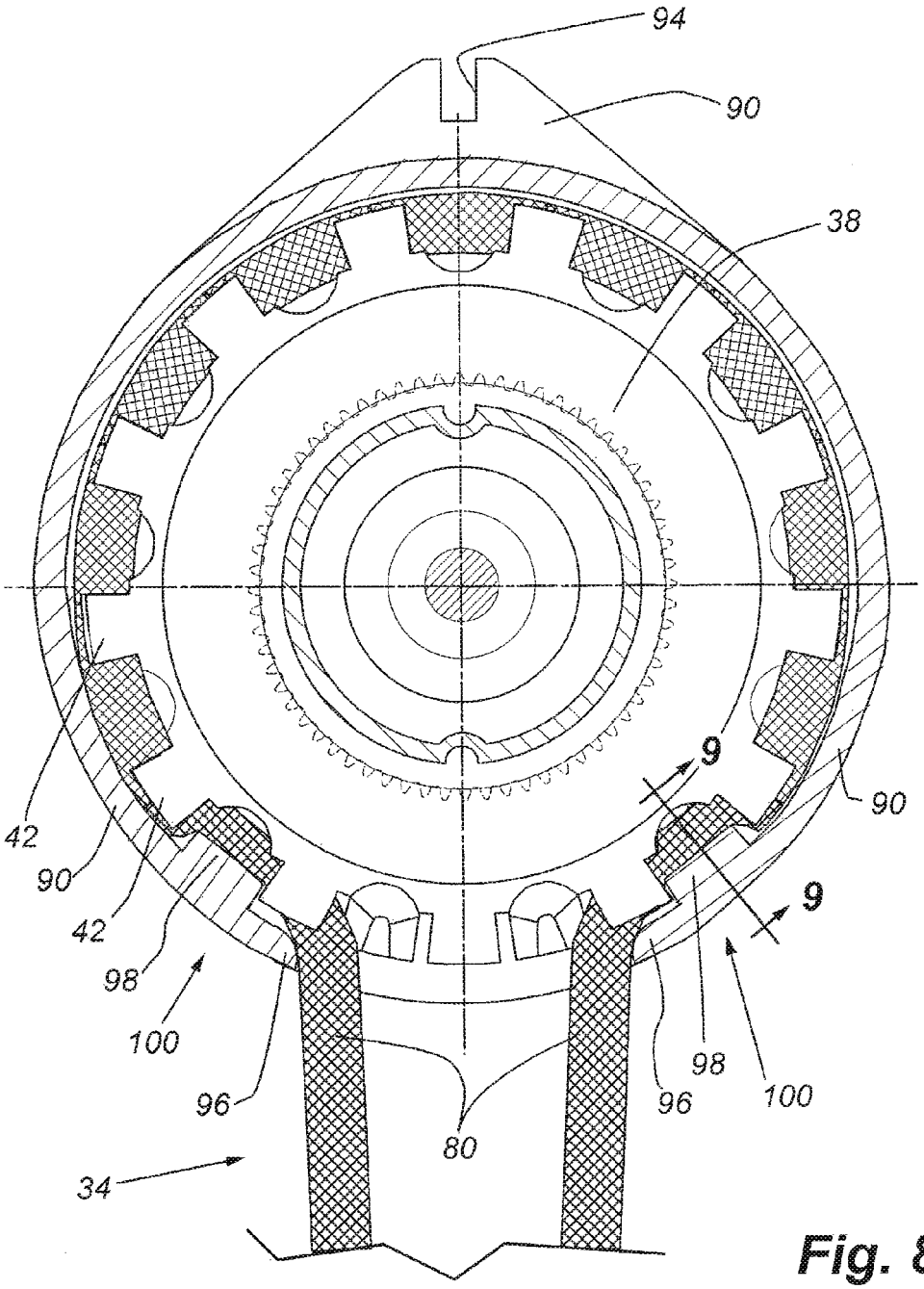
FIG. 8 is a section similar to FIG. 7 showing the clamp system in a gripping position.
Figure 9:
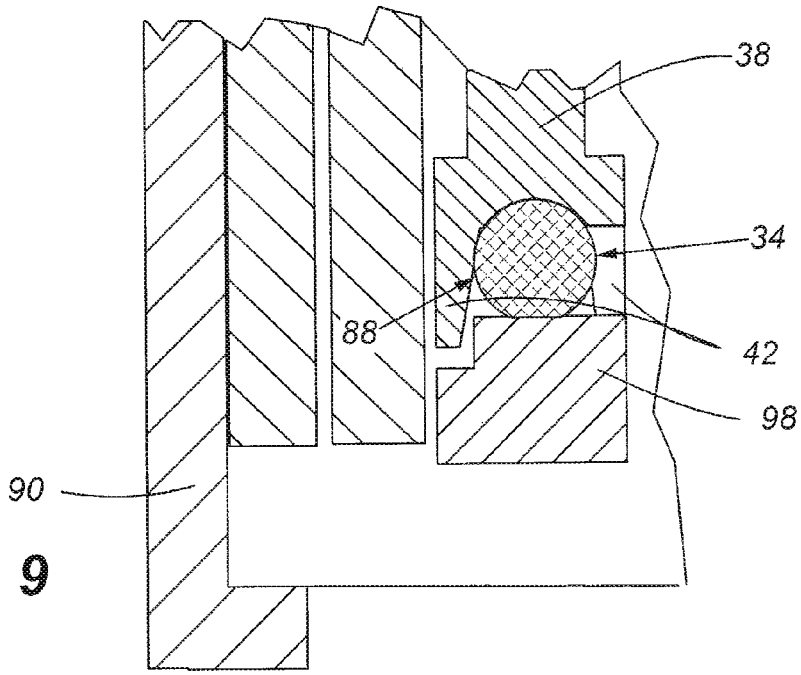
FIG. 9 is a further enlarged section along line 9-9 of FIG. 8 showing the clamping system in a gripping position.
Figure 10:
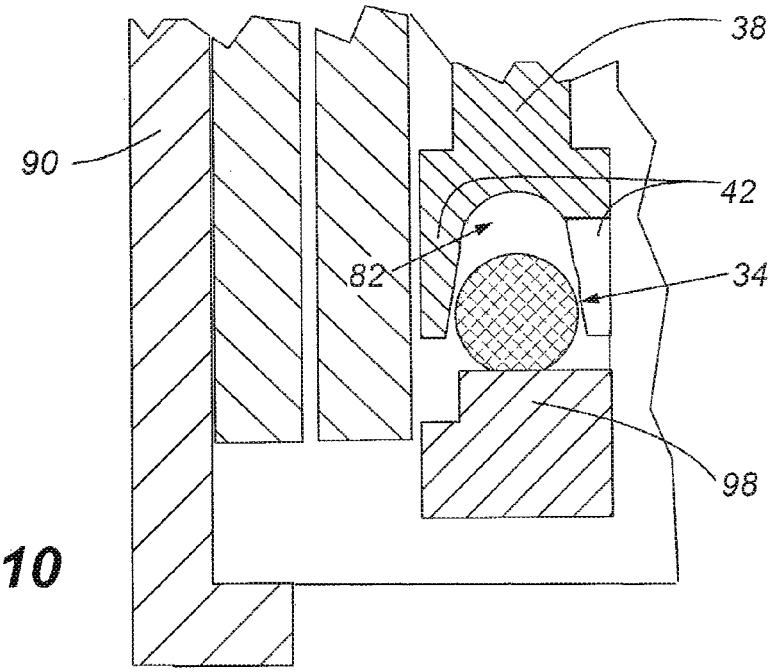
FIG. 10 is a section similar to FIG. 9 showing the clamping system in a nongripping or released position.

The clamp system pursuant to this embodiment again includes two independent clamps 100 with each clamp being associated with one of the dogs 98 at the lower end of the shroud. FIGS. 7 and 10 show the clamps in a released state while FIGS. 8 and 9 show a clamp in a neutral gripping position. In a neutral gripping position, the spring bias of the shroud naturally forces the dogs up into the circumferential channel defined by the teeth 42 of the drive wheel and in which the operating cord is confined. The bias of the shroud is sufficient to grip the drive wheel and/or the operating cord and due to the cord's frictional engagement with the drive wheel or the cord, the cord and dog remain in a fixed position inasmuch as the shroud itself cannot move relative to the headrail thereby preventing the associated dogs from moving as well as the cord and drive wheel with which the dogs are engaged. The lower edges 96 of the shroud, as best seen in FIGS. 8 and 9, can be seen to be curved so as to provide a smooth surface across which the operating cord can slidably pass to minimize wear on the cord.

FIGS. 9 and 10 illustrate probably best the operation of the system. FIG. 9 again illustrates a clamp 100 of the clamp system in a neutral gripping relationship with the drive wheel 38 and/or the cord so that all are held in an immobile position. If an installer of the system properly installs the tensioner to place enough downward pull on the cord to release the dogs 98 from their gripping engagement with the drive wheel and/or operating cord, the drive wheel can be rotated with the cord to desirably operate the covering. As seen in FIG. 10, the cord is thereby free to slide relative to the adjacent dog but due to the gripping engagement of the cord with the drive wheel, circulating movement of the operating cord causes the drive wheel to rotate in unison therewith along with the roller which supports the shade material. When it is desired to leave the roller 18 and shade material 82 in a predetermined position, and internal clutch/brake system may be used.

From the above, it will be appreciated that a retractable covering can be prevented from operating unless the tensioner is properly mounted and if the tensioner is properly mounted, the risk of an infant or child becoming entangled in the cord is minimized.

Figure 11:
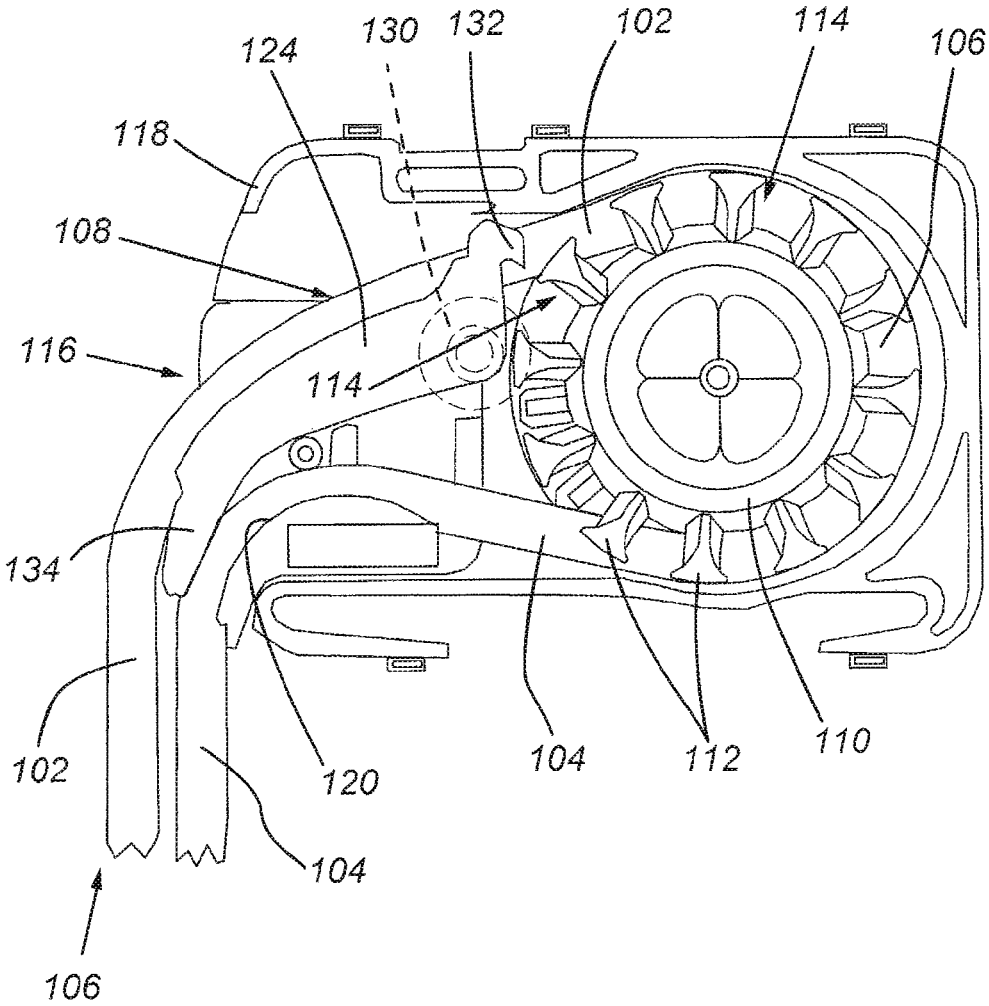
FIG. 11 is a section taken through the end of a headrail pursuant to a third embodiment of the disclosure with the section being similarly located to that of FIG. 7 of the second-described embodiment and with a lock arm in a neutral locked position.
Figure 12:
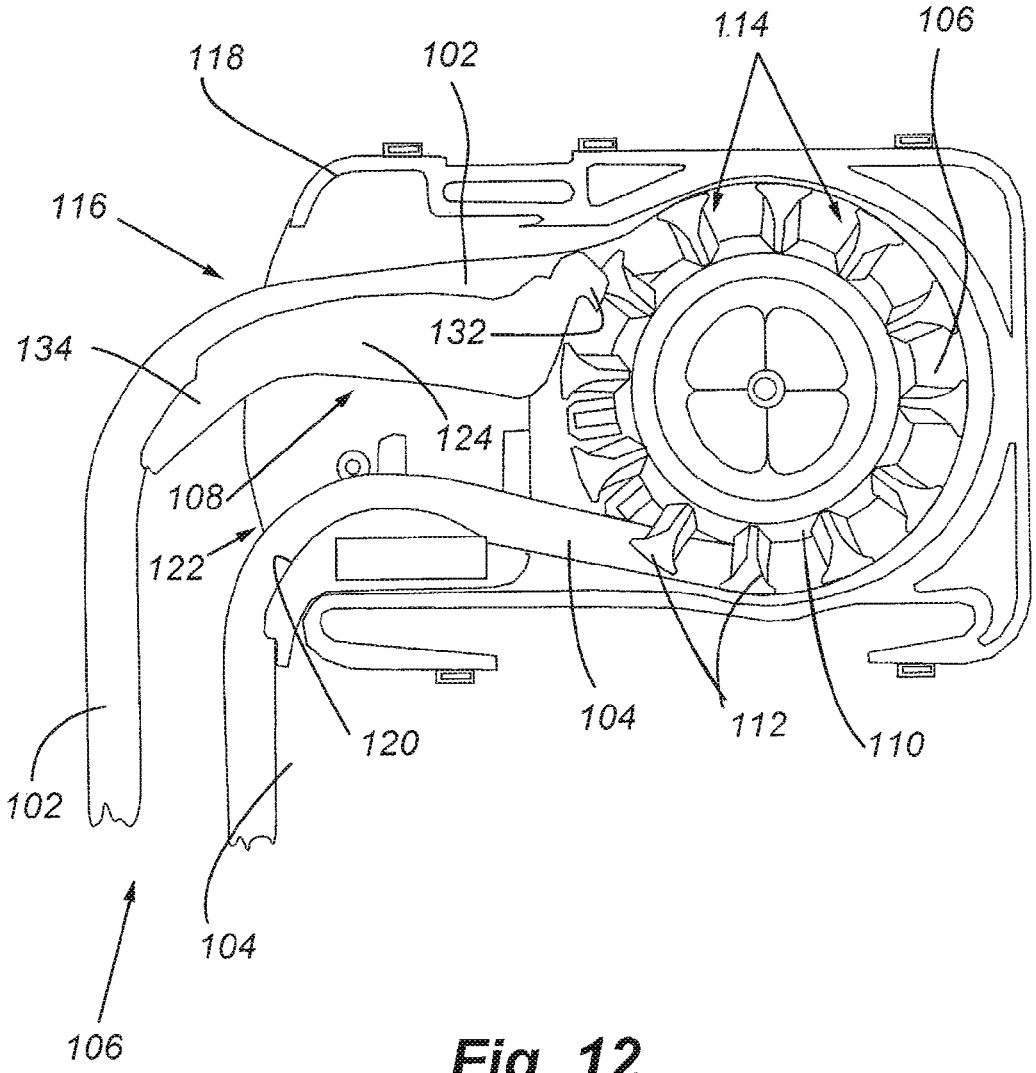
FIG. 12 is a section similar to FIG. 11 with the lock arm in a released or unlocked position.
Figure 13:
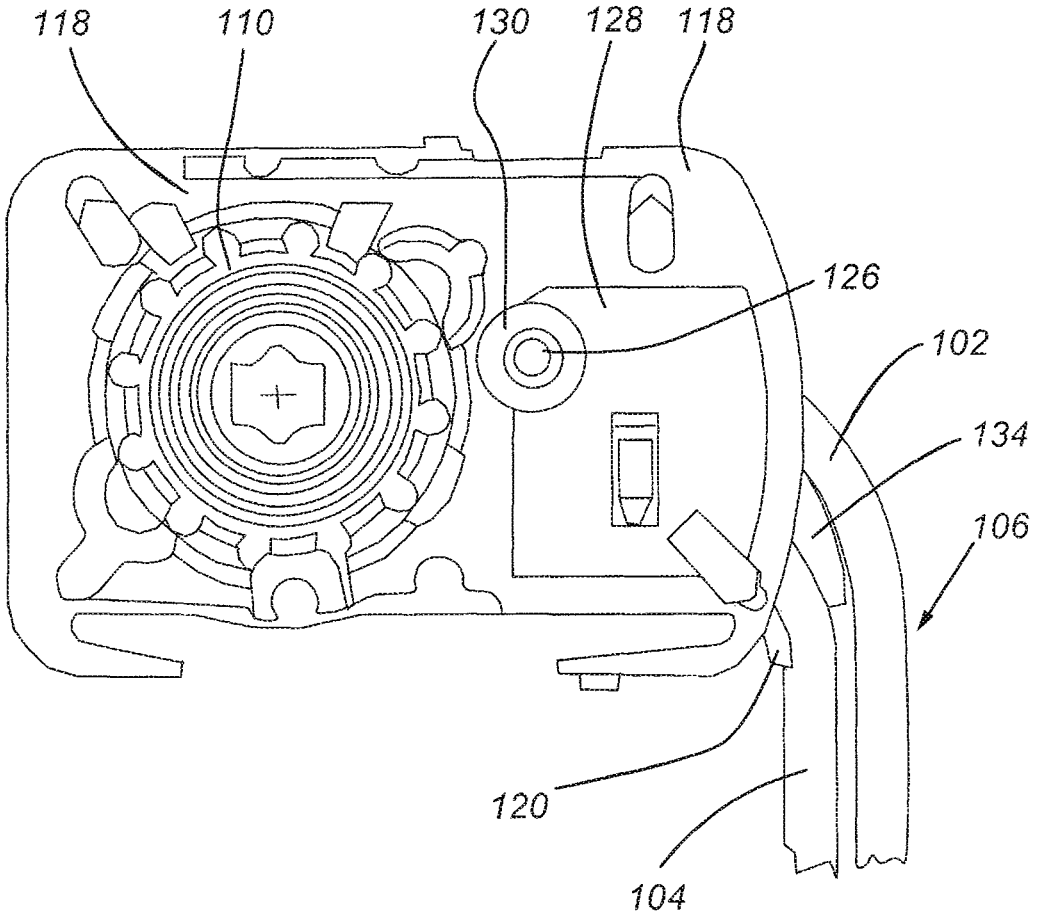
FIG. 13 is a section looking at the reverse side of the drive wheel as shown in FIG. 12 showing a pivotal spring bias mounting of the lock arm.

A third embodiment of the present disclosure is shown in FIGS. 11, 12, and 13 with this embodiment illustrating upper 102 and lower 104 runs of the operating cord 106 extending laterally again similar to the first-described embodiment of the disclosure, but in this embodiment, a releasable lock system 108 operatively engages the drive wheel 110 as is possible with the second-described embodiment but does so in a different manner. By engaging the drive wheel, as opposed to the operating cord itself, undue wear on the cord can be avoided.

A roller associated with this third embodiment of the disclosure, which is not seen, may be identical to that of the first two described embodiments and again would have a toothed drive wheel 110 on one end thereof which is associated with the operating cord system of the present disclosure. A similar operating system could be provided at the opposite end of the covering for other operations even though that is not illustrated.

The drive wheel 110 again has a plurality of circumferentially spaced but radially extending teeth 112 defining saddles or seats 114 in which the operating cord 106 is positioned as it extends substantially around the drive wheel. The teeth are designed to grip the cord so that as the operating cord is circulated, the drive wheel is rotated in unison therewith so as to also rotate the roller accordingly.

In this embodiment, the lower run 104 of the operating cord 106 leaves the bottom of the drive wheel and extends out an opening 116 in the front of the headrail 118 across a smooth guide surface 120 secured in any suitable manner within the headrail. The upper run 102 of the operating cord extends off the top of the drive wheel again out an opening 122 in the front of the headrail, and it slides within a transversely arched groove (not seen) provided longitudinally in the top surface of a pivotal lock arm 124. The pivotal lock arm is mounted on a pivot pin 126 which extends through a vertical transversely extending wall 128 in the headrail and is keyed to a tensioned torque spring 130 so as to be biased in a clockwise direction as viewed in FIGS. 11 and 12. The internal end of the lock arm has a catch or dog 132 in the form of a hook adapted to be inserted into a saddle or seat 114 in the drive wheel when the lock arm is in its neutral locking position of FIG. 12. When the catch is so positioned, it will be appreciated the drive wheel 110 cannot rotate in either direction, but the catch may not be engaged with the operating cord 106 itself but only the drive wheel so as not to unnecessarily wear the cord when the lock arm is being moved between its locked and unlocked positions.

As mentioned, the lock arm 124 is biased toward the locked position of FIG. 12 with the torque spring 130 and will remain in that position until a predetermined force is applied to the upper run 102 of the operating cord as it passes over the outer end 134 of the lock arm which is opposite from the end having the catch 132. When a downward force is applied to the upper run, it pivots the lock arm in a counterclockwise direction about its pivot pin 126 against the bias of the torque spring thereby lifting the catch 132 out of the associated saddle or seat 114 in the drive wheel as seen in FIG. 11 so that the drive wheel is free to rotate with the roller and the operating cord.

As with the previously described embodiments of the present disclosure, if a cord tensioner associated with this embodiment, which would be identical to that of the previous two embodiments, is properly mounted so that a predetermined amount of tension is placed in the operating cord with the cord held closely adjacent to the frame of the architectural opening, an adequate downward pull is provided on the upper run 102 of the operating cord so as to move the lock arm 124 to its unlocked position of FIG. 11 where the covering will operate in its desired manner. If, however, the tensioner is not properly mounted, or is not mounted at all, so that an adequate downward force is not placed on the upper run of the operating cord, the bias placed on the lock arm moves and retains the catch 132 in locking engagement with the wheel so that the covering will not operate.

As can be appreciated from the above, the lock arm 124 positively engages the drive wheel for dependable operation. The torque spring 130, which biases the lock arm into its locking position, is also embedded within the headrail where it cannot be touched by a consumer making the system tamper-proof to the consumer. When the shade is shipped, it may be shipped with the shade material retracted and the lock arm 124 in its locking position. The system may also be set up and shipped such that the lower run 104 is the run of the cord which must be pulled to lower the shade. As will be appreciated from the description above, however, the lower run 104 cannot be pulled to lower or extend the shade material until the lock arm 124 is released and remains released which only occurs if the tensioner is mounted and mounted properly to the frame of the architectural opening to hold the lock arm in its released or unlocked position.

Accordingly, like the previous two embodiments, this embodiment assures that the tensioner for the cord is not only mounted but is mounted properly so the covering can operate in a desired manner and wherein a child or infant is protected from becoming entangled in the operating cord.

While the preferred embodiments of the disclosure have been discussed in detail, it should not be considered a limitation on the disclosure, but merely exemplary thereof. The disclosure is to be limited only by the following claims:

What is claimed is:

1. An operating cord system for a covering for architectural openings comprising:

a roller;

a drive wheel positioned at one end of the roller and connected to the roller for unitary rotation therewith;

a flexible shade material connected to the roller, wherein movement of the roller transitions the flexible shade material from a retracted position to an extended position;

an elongated operating cord formed in a closed loop and connected to the roller to reversibly rotate the roller by circulating the operating cord in reversible directions, wherein the operating cord is connected to the roller by grippingly passing at least partially around the drive wheel, and wherein circulation of the operating cord effects rotation of the roller;

a tensioner around which the operating cord extends to apply tension to the operating cord between the tensioner and the roller; and a releasable clamp system connected to at least a portion of a length of the operating cord to prevent circulation thereof, the clamp system including at least one biased dog movable from a clamping position to a releasing position, wherein the at least one biased dog is positioned to engage at least one of the drive wheel or the operating cord to prevent rotation of the drive wheel and the operating cord, wherein the at least one biased dog is mounted on a resilient shroud at least partially surrounding the drive wheel, the shroud yieldingly biasing the at least one biased dog toward the drive wheel, and wherein in the clamping position the at least one dog engages the operating cord to pinch the operating cord against the drive wheel.

2. The system of claim 1, wherein the clamp system comprises two independent clamps.

3. The system of claim 1, wherein the roller is horizontally disposed and the operating cord extends vertically from the roller.

4. The system of claim 1, wherein the at least one biased dog comprises a first biased dog and a second biased dog.

5. The system of claim 4, wherein the shroud has opposite longitudinally extending edges, the first dog is operably connected to one of the longitudinally extending edges and the second dog is operably connected to the other of the longitudinally extending edges.

6. The system of claim 1, wherein the at least one biased dog and the drive wheel are positioned on opposite sides of the operating cord.

7. A cord tensioning system for an architectural covering comprising:

a roller connected to the architectural covering;

an operating cord connected to the roller and configured to rotate the roller;

a rotatable drive wheel connected to the roller and the operating cord;

a clamping system for selectively preventing the drive wheel from rotating, the clamping system including:

a first dog associated with the operating cord;

a second dog associated with the operating cord; and a shroud having a first edge and a second edge, the shroud secured to the headrail and at least partially surrounding the drive wheel, wherein the first and second dogs are mounted on an inner surface of the first and second edges, respectively, and are biased inwardly towards the drive wheel;

a headrail at least partially enclosing the roller and the clamping system; and a tensioner connected to the operating cord for applying tension to the operating cord, wherein the tension applied to the operating cord by the tensioner is sufficient to move both the first dog and the second dog from a clamped position preventing rotation of the drive wheel to a released position permitting rotation of the drive wheel.

8. The cord tensioning system of claim 7, wherein the tensioner further comprises:

a pulley threaded onto the operating cord; and a spring associated with the operating cord and positioned substantially perpendicularly with the respect to the roller, the spring providing the tension to the operating cord, which in turns provides a release force to the clamping system.

9. The cord tensioning system of claim 7, wherein the tension applied to the operating cord by the tensioner disengages the clamping system from the drive wheel.

10. The cord tensioning system of claim 7, wherein:

the drive wheel includes a plurality of circumferentially-spaced, radially-extending teeth defining saddles in which the operating cord is positioned; and the first and second dogs are biased at least partially into one or more of the saddles defined by the teeth.

11. The cord tensioning system of claim 7, wherein the operating cord is positioned between the drive wheel and the first and second dogs.

12. The cord tensioning system of claim 11, wherein the tension applied to the operating cord by the tensioner moves the first dog and the second dog outwardly away from the drive wheel.

13. The system of claim 1, wherein:

the drive wheel includes a plurality of circumferentially-spaced, radially-extending teeth defining saddles in which the operating cord is positioned as it passes at least partially around the drive wheel; and in the clamping position the at least one biased dog is positioned at least partially in one or more of the saddles defined by the teeth.

14. The system of claim 1, wherein:

the tensioner includes a slidable pulley around which the operating cord extends; and the slidable pulley is biased away from the roller by a coil spring.

15. The system of claim 1, wherein the tension applied to the operating cord by the tensioner is sufficient to move the at least one biased dog from the clamping position to the releasing position.

16. The system of claim 1, wherein the releasable clamp system is configured such that the at least one biased dog permits circulation of the operating cord when the tensioner is properly mounted relative to the roller and otherwise prevents circulation of the operating cord.

17. A cord tensioning system for an architectural covering comprising:

a roller;

a drive wheel connected to the roller for unitary rotation therewith;

an operating cord formed in a closed loop and routed at least partially around the drive wheel;

a clamp system including:

a shroud at least partially surrounding the drive wheel; and at least one dog mounted on an inner surface of the shroud, wherein the operating cord extends between the at least one dog and the drive wheel, and wherein in a neutral position the at least one dog is positioned to engage at least one of the drive wheel or the operating cord to prevent the drive wheel from rotating; and a tensioner connected to the operating cord to apply tension to the operating cord, wherein:

the shroud includes a first edge and a second edge;

the at least one dog comprises a first dog mounted on an inner surface of the first edge and a second dog mounted on an inner surface of the second edge;

the first and second dogs engage the operating cord; and the tension applied to the operating cord by the tensioner is sufficient to move the first and second dogs outwardly away from the drive wheel to permit rotation of the drive wheel.

* * * * *